US006408576B1

(12) United States Patent
Roth

(10) Patent No.: US 6,408,576 B1
(45) Date of Patent: Jun. 25, 2002

(54) ARCH MOLD APPARATUS AND METHOD FOR MAKING ARCHES

(76) Inventor: Douglas Roth, 4829 Badger Rd., West Palm Beach, FL (US) 33417

( * ) Notice: Subject to any disclaimer, the term of this patent is extended or adjusted under 35 U.S.C. 154(b) by 14 days.

(21) Appl. No.: 09/693,212

(22) Filed: Oct. 20, 2000

(51) Int. Cl.[7] ..... E04G 15/02; E06B 1/24

(52) U.S. Cl. ..... 52/85; 52/254; 52/255; 52/287.1; 249/48; 249/209

(58) Field of Search ..... 249/48, 209; 52/254, 52/255, 287.1, 85

(56) References Cited

U.S. PATENT DOCUMENTS

| | | | | |
|---|---|---|---|---|
| 1,782,147 A | | 11/1930 | Merryweather | |
| 1,931,889 A | | 10/1933 | Brainard et al. | |
| 2,344,279 A | | 3/1944 | Beerthuis | |
| 2,442,929 A | | 6/1948 | Marino | |
| 3,008,273 A | | 11/1961 | Widin | |
| 3,765,138 A | * | 10/1973 | Bentle | 52/288 |
| 4,301,632 A | | 11/1981 | Wagner | |
| 4,315,390 A | * | 2/1982 | Schaafsma | 52/288 |
| 4,400,917 A | | 8/1983 | Massaro et al. | |
| 4,601,138 A | | 7/1986 | Hampton | |
| 5,572,834 A | | 11/1996 | Lilly | |
| 5,645,372 A | * | 7/1997 | Hahn | 52/20 |
| 5,671,583 A | * | 9/1997 | Turner | 52/745.16 |
| 6,195,945 B1 | * | 3/2001 | McGarry et al. | 52/88 |

* cited by examiner

*Primary Examiner*—Beth A. Stephen
*Assistant Examiner*—Chi Q Nguyen

(57) ABSTRACT

Doorway or passageway arches and a mold and method for making doorway arches, wherein the arches comprise prefabricated plaster, two sides that are substantially perpendicular to each other, a concave arcuate side extending between the sides and flanges extending outward from each side for securing the arch to adjoining walls defining a comer, and the mold comprises a base, at least two perpendicularly disposed slots, at least one slidably insertable and removable board for each slot, a mold projecting upward from said base and having a convex side extending between opposing ends of said boards, flanges disposable along the boards and a volume for receiving a hardening agent, such as plaster.

13 Claims, 7 Drawing Sheets

ARCH MOLD APPARATUS AND METHOD FOR MAKING ARCHES

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to doorway or passageway arches and a mold and method for making doorway arches, and more particularly, to a pre-fabricated plaster arch having exposed flanges that allow it to be easily installed in any doorway and a mold and method for making plaster arches that allows plaster arches to be completely made prior to installation.

2. Description of the Background Art

The construction of arches in doorways, or passageways, can be tedious, expensive and time-consuming work. In fact, this type of work invariably has to be done by a trained carpenter. The construction of arches typically involves cutting plywood and drywall into the desired semi-circle arched shape, making cross-members (usually from 2×4 studs) for securely joining the plywood in a manner that corresponds to the thickness of the passageway wall, securing the plywood to the cross-members to form the framework, mounting the drywall to the plywood, attaching comer beads, taping all seams, and floating or filling the seams. Some pre-framed arches are known in the art, however, they are not complete. That is, they still require the use of plaster or stucco, drywall, tape, floating and comer beads, and can be difficult to install. There are no known devices, molds or methods that allow a plaster arch to be made before installation so that it only needs to be mounted to the comer of the passageway and made flush with the wall. A pre-fabricated plaster-based arch would help carpenters save time and customers save money and could be installed by non-professionals as well. Consequently, a device or method for simplifying the construction of passageway arches would be well received.

Several arch members and methods for making arches are known in the background art. However, none of these addresses or solves the above-noted problems associated with making and mounting arches. The patent references found fail to disclose important structural elements of the instant invention. For instance, U.S. Pat. No. 1,782,147 discloses a metal arch member for openings comprising a box-like arcuate member that is mounted to a comer of a doorway for adhering plaster. U.S. Pat. No. 1,931,889 discloses a metal cove and bracket for producing an arcuate cove between a wall and ceiling. U.S. Pat. No. 2,344,279 discloses a plastering base comprising a pre-formed base strip for attachment to doorway studs and applying plaster. U.S. Pat. No. 2,442,929 discloses an arch member for openings comprising a support or base adapted to be covered with plaster. U.S. Pat. No. 3,008,273 discloses a hollow preformed arch and method of making the same comprising plasterboard panels and metal comer beads having a plurality of slits for gripping cement. The method generally comprises forming a curved panel by making a plurality of parallel kerf cuts therein, placing the panel over an arcuate form and applying plaster in the kerf cuts. U.S. Pat. No. 4,301,632 discloses a prefabricated full archway module having a pair of parallel upright panels extending between the floor and ceiling with internal braces and modules defining the upper portion of an archway. U.S. Pat. No. 4,400,917 discloses a unitary structure for a full arch-shaped passageway, which is adapted for drywall construction. The unitary structure includes a front panel, a rear panel and an arcuate panel portion therebetween. U.S. Pat. No. 4,601,138 discloses a prefabricated unitary body forming an archway including a comer bead and a recess therefor. U.S. Pat. No. 5,572,834 discloses a prefabricated arch form for use in constructing an archway wherein opposing sheet metal cheek are spaced apart by a curved throat to permit the cheeks to reside between the adjacent wall support and drywall and to fasten drywall. The foregoing art fails to disclose a prefabricated plaster arch or a mold, kit and/or method for making a prefabricated plaster arch as contemplated by the instant invention.

As the above noted art fails to provide a device or method that fills the foregoing gap in the prior art, there exists a need for a prefabricated plaster arch and mold, kit and method for making the same. The instant invention solves this problem by providing a prefabricated plaster arch that is installation ready, and a mold or kit and method for making plaster arches.

BRIEF SUMMARY OF THE INVENTION

Based on the foregoing, it is a primary object of the instant invention to provide a prefabricated plaster arch or semi-arch that is installation ready.

It is an additional object of the instant invention to provide a prefabricated plaster arch or semi-arch that is easy to install and inexpensive.

It is another object of the instant invention to provide a prefabricated plaster arch or semi-arch that can be installed with common fasteners and only requires that the gap between the arch and wall be covered.

It is also an object of the instant invention to provide a mold that facilitates the making of plaster arches or semi-arches.

It is a further object of the instant invention to provide a method for making plaster arches or semi-arches.

In light of these and other objects, the instant invention comprises a prefabricated plaster arch or semi-arch ready for installation in the corner of a passageway, and a mold, kit and method for making a plaster arch. The plaster arch generally comprises two substantially perpendicular leg portions that meet at a common end, a concave arcuate surface between the two free ends of the leg portions and securing tabs extending outward from each leg. The leg portions form a right angle so that the arch fits within the comer of an opening, passageway or any wall and upper horizontal surface, such as a ceiling. The securing tabs are adaptable for securely receiving and/or passing conventional fasteners, such as screws, nails and anchors, that attach the tabs, and hence the arch, to the horizontal ceiling-like surface and vertical wall-like surface forming the opening. A full arch is formed by placing a prefabricated arch in opposing corners. The width of the arch corresponds to the width of the wall, but can vary. The length of the legs can vary to accommodate the desired look of the arch or arches and can be based on the size of the mold. The plaster arch can also include arcuate corner beads set in the plaster. The arcuate corner beads have slits at predetermined distances, such as an inch, to facilitate easy bending and shaping. The securing tabs may be defined by and project out from a securing clamp that provides a surface for the fill to adhere or grip to. The securing clamp is set in the fill and also includes a plaster retaining surface, locking tabs and/or additional reinforcement members extending therefrom plaster to improve the structural integrity of the arch and to prevent removal of the securing clamps and tabs.

The invention also comprises a mold, kit and method for making pre-fabricated doorway arches. The mold generally comprises a main mold body formed by a box-like structure having a bottom panel, at least two substantially perpendicular and removable side panels and one concave and arcuate panel bridging the side panels and defining a chamber therebetween and therein for filling with plaster or plaster-like material. The mold may also include a second set of substantially perpendicular and removable side panels opposing the first set of side panels and a second concave and arcuate panel joining the second set of side panels. The second set of side panels and second arcuate panel define a chamber therebetween and therein such that the mold forms a second arch when the second chamber is filled with plaster or a plaster-like material. The mold of the instant invention can therefore form up to two substantially uniform plaster arches by setting the securing tabs in the voids and filling the chambers with plaster, paste, concrete, stucco, liquid plastic, joint compound or other suitable filler. The side panels are preferably removable from the main body to facilitate convenient removal of the arches once they have set. The side panels may slide within tracks formed in the bottom panel. The mold body also makes it convenient to uniformly and evenly remove excess filler from the chamber(s) with a trowel blade and to set an arcuate corner bead in the fill.

The kit of the invention includes the mold main body, at least two securing tabs and a filler mix for filling the chamber(s). The kit may further include at least one pair of corner beads having slits cut therein for facilitating easy shaping. The main body comprises at least one set of side panels and at least one arcuate panel, but preferably includes two sets of side panels and two arcuate panels. The side panels are preferably removable. The main body may also include a removable top for accessing the chamber(s) when filling and covering the chamber(s) when the fill is setting and curing. The mold and kit may also include a retaining strap for holding the side panels in place.

The method of making prefabricated plaster arches generally comprise setting up the mold, filling at least one chamber in the mold with a suitable fill, leveling the fill, allowing the fill to set, removing the side panels and removing the arch or arches from the mold. The mold is set up by securely installing or mounting the side panels, setting the arcuate panels if not already fixed to the bottom panel, and setting and orienting the securing clamps in the chambers adjacent the side panels. The arches are then made by filling the chamber or chambers with a suitable fill, leveling the fill with a trowel or other suitable instrument, allowing the fill to set and cure, removing the side panels and removing the arch or arches once the fill has set or cured. The method may also include securing a strap around the outside of the mold to secure the side panels and/or placing a first corner bead along the bottom of the arcuate panel before filling and placing a second comer bead along the top of the arcuate panel after filling the chamber or chambers. The method of the invention may further include installation of at least one arch or two arches, which comprises the steps of aligning the plaster arch in the desired corner of the desired opening, passing or forcing at least one fastener through each securing tab into the corresponding wall surface behind the securing tab, filling or concealing the seams between the arch and wall/ceiling surface with a joint compound, sanding or texturing the surface smooth and painting the arch.

In accordance with these and other objects, which will become apparent hereinafter, the instant invention will now be described with particular reference to the accompanying drawings.

DETAILED DESCRIPTION OF THE INVENTION

Figure 1A:
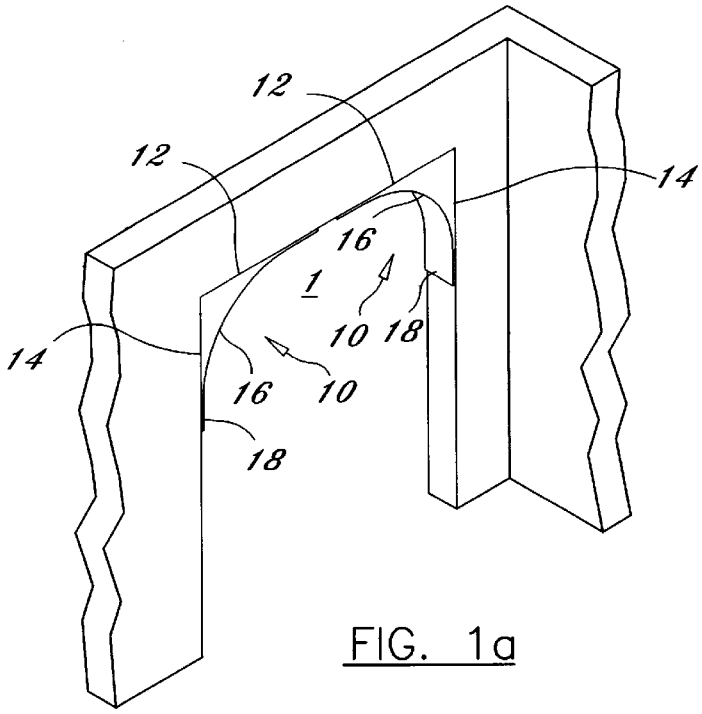
FIG. 1*a* is a front perspective view of the preferred embodiment of the prefabricated plaster arches of the instant invention installed in a passageway.
Figure 1B:
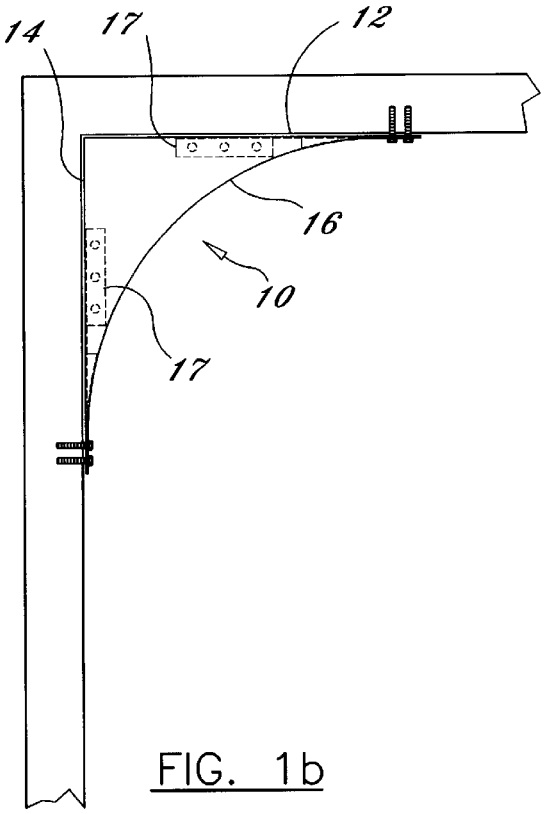
FIG. 1*b* is a front elevational full cut-away view of the preferred embodiment of the prefabricated plaster arches of the instant invention as installed in a passageway to make a semi-arch.
Figure 1C:
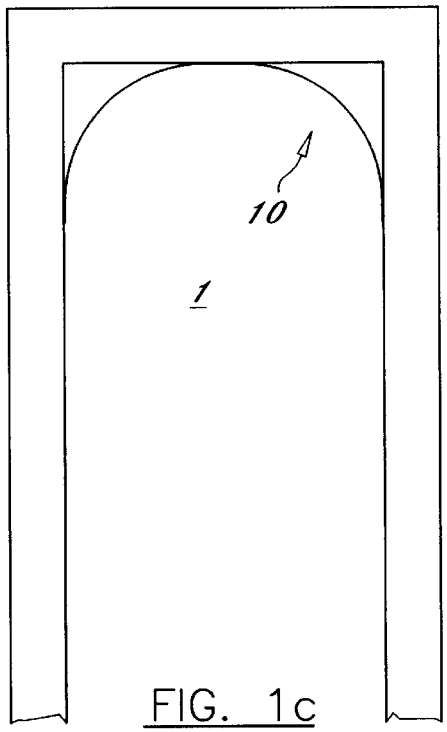
FIG. 1*c* is a front elevational view of the preferred embodiment of the prefabricated plaster arches of the instant invention showing two arches installed in a passageway to make a full arch.
Figure 2:
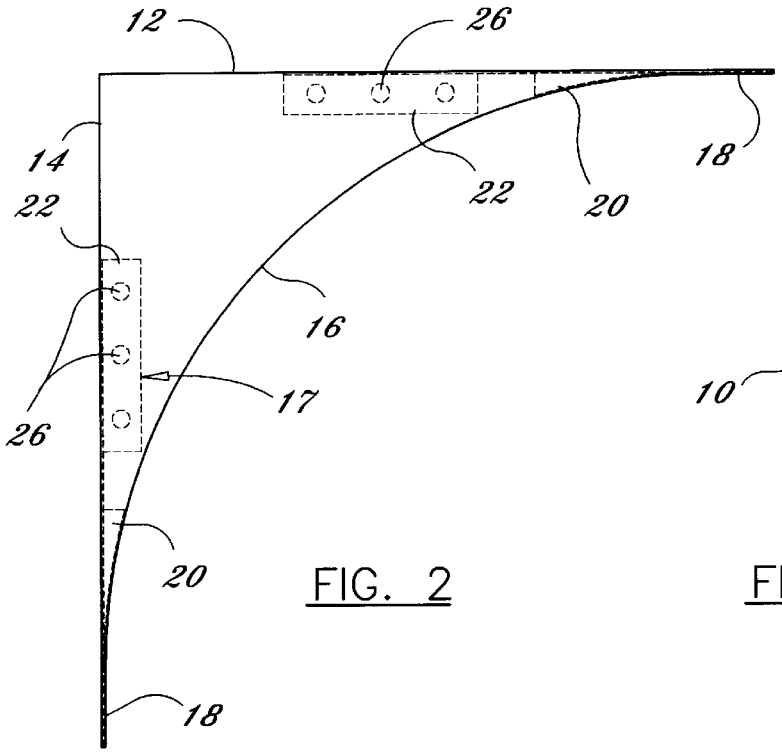
FIG. 2 is a front elevational view of the preferred embodiment of the prefabricated plaster arches of the instant invention showing the securing clamp in phantom.
Figure 4:
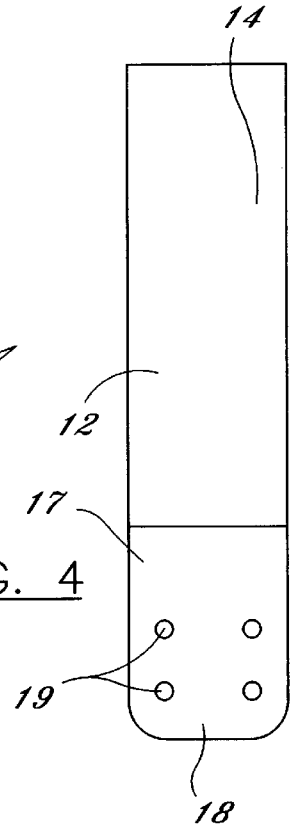
FIG. 4 is an end elevational view of the preferred embodiment of the prefabricated plaster arches of the instant invention.
Figure 3:
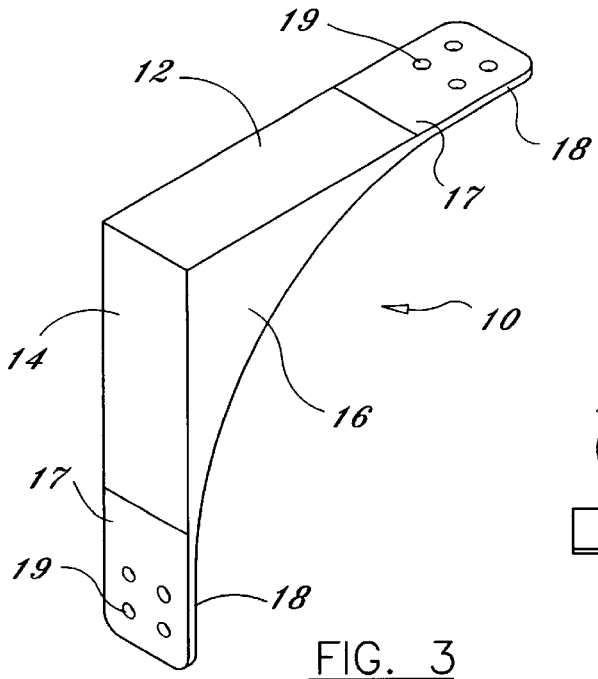
FIG. 3 is a perspective view of the preferred embodiment of the prefabricated plaster arches of the instant invention.

With reference to the drawings, FIGS. 1*a*–11 depict the preferred and alternative embodiments of the prefabricated plaster arches and mold of the instant invention, which are generally characterized by reference numerals 10 and 50 respectively. Referring to FIGS. 1*a*–1*c*, the instant invention comprises a prefabricated plaster arch 10 that fits in the corner of an opening or passageway 1 and may also be classified as a quarter arch. With reference to FIGS. 1*a*–4, the prefabricated plaster arch 10 comprises a first leg portion 12, a second leg portion 14, a concave arcuate surface 16 and securing tabs 18. The prefabricated arch 10 is preferably made from a plaster fill 30 or plaster-like material, paste, concrete, stucco, liquid plastic, joint compound or other suitable filler. The first and second leg portions 12, 14 meet at a common end in a substantially perpendicular orientation. The concave arcuate surface 18 joins the two free ends of the leg portions 12, 14. The width of the arch 10 corresponds to the width of the corresponding wall, which typically vary between 2.5 inches and 5.0 inches. The length of the leg portions 12, 14 can also vary to accommodate the desired look of the archway. For instance, the top leg portions 12 can comprise half the width of an opening 1 such that the securement of a prefabricated arch 10 in opposing corners creates a full archway, as shown in FIG. 1*c*. Conversely, the top leg portions 12 may comprise a length that is less than half the width of an opening 1, so as to form only two opposing quarter arches, as shown in FIG. 1*c*. A securing tab 18 projects outward from each leg portion 12, 14 and is adaptable for receiving fastening hardware, such as screws, nails, anchors and/or other known fasteners, to secure the arch 10 to a wall and/or ceiling surface, as shown in FIGS. 1*a* and 1*b*. The securing tabs 18 may define securing apertures 19, as shown in FIGS. 3 and 4.

Figure 5:
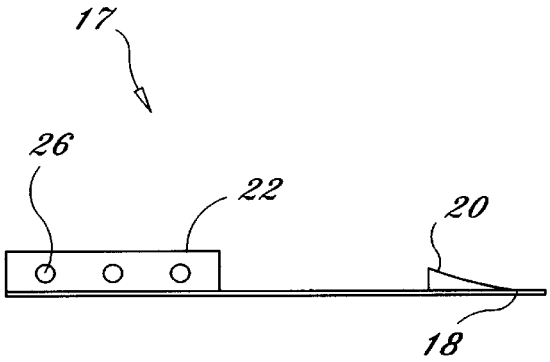
FIG. 5 is a side elevational view of the securing clamp used in the preferred embodiment of the prefabricated plaster arches of the instant invention.
Figure 6:
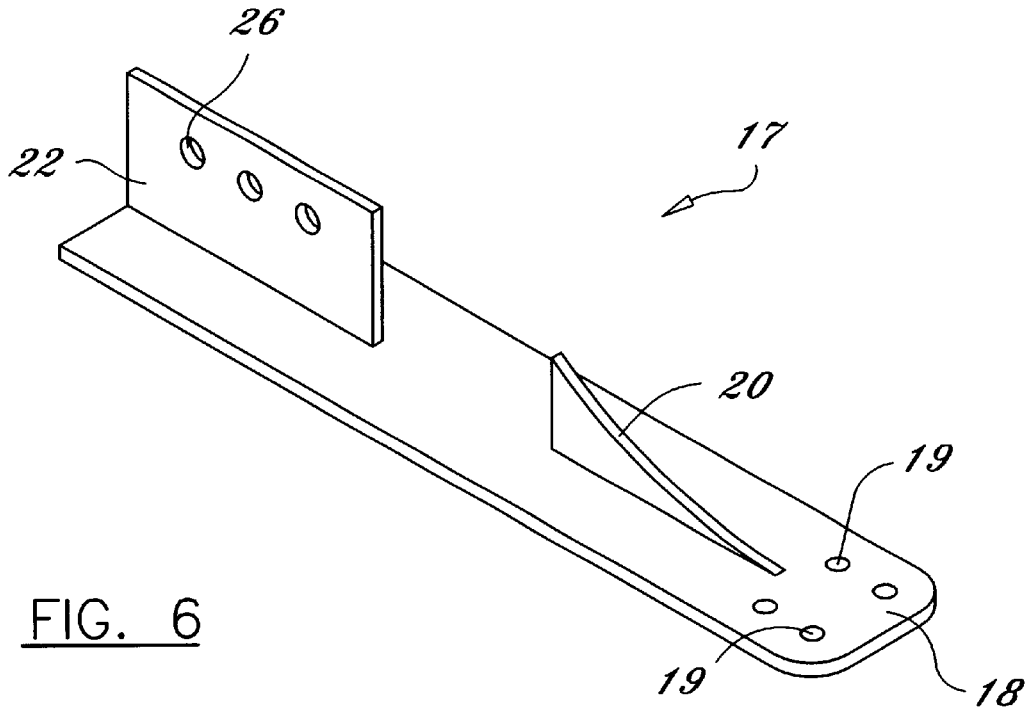
FIG. 6 is a perspective view of the preferred securing clamp used in the preferred embodiment of the prefabricated plaster arches of the instant invention.
Figure 7:
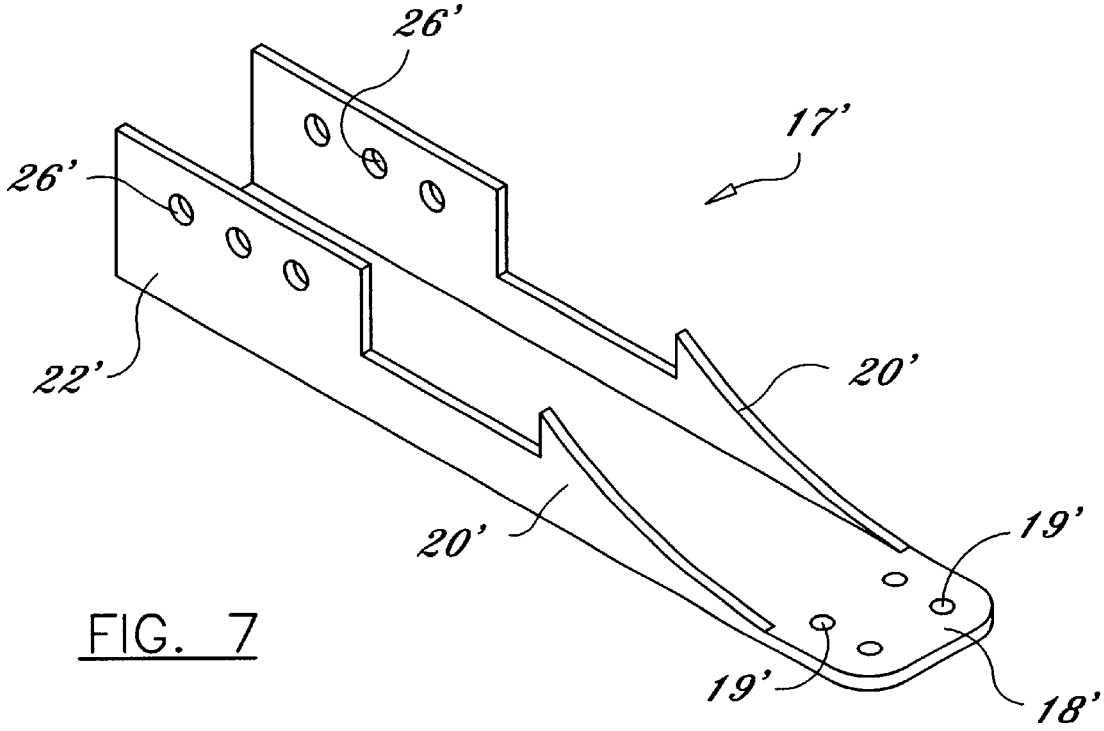
FIG. 7 is a perspective view of an alternative securing clamp used in the preferred embodiment of the prefabricated plaster arches of the instant invention.

With reference to FIGS. 5–7, the securing tab 18 is preferably defined by a securing clamp 17, which resides in the body of the prefabricated arch. The securing clamp 17 comprises a securing tab 18, fastening apertures 19, at least one plaster retaining projection 20, at least one locking tab 22 and locking tab apertures 26. Referring to FIGS. 5 and 6, the plaster retainer projection 20 projects upward from a base section and comprises an arcuate top edge having a radius of curvature corresponding to the arcuate surface 18 of the arcuate molding surface 56 and hence the prefabricated arch. The locking tab 22 preferably comprises at least one upward projecting plate having a plurality of apertures for reinforcing the plaster or plaster-like fill making up the arch 10. n an alternative embodiment, the securing clamp 17' may comprise at least two plaster retaining projections 20' and at least two locking tabs 22' extending upward from the base section along and proximal to opposing edges, as shown in FIG. 7. The alternative retaining projections also define top arcuate edges having radii of curvature corresponding to the arcuate molding surface 56 and the arcuate surface defined by the arch 10. The securing clamps 17, 17' provide reinforcement for the plaster 30 or plaster-like fill to strengthen the structural integrity of the arches 10, prevent removal of the clamps 17, 17' and tabs 18, 18' from the arches 10 and provide a surface for securing the arches 10 to a wall and/or ceiling. The securing tabs 18, 18' may include fastening apertures 19, 19' for passing hardware requiring an aperture.

Figure 8:
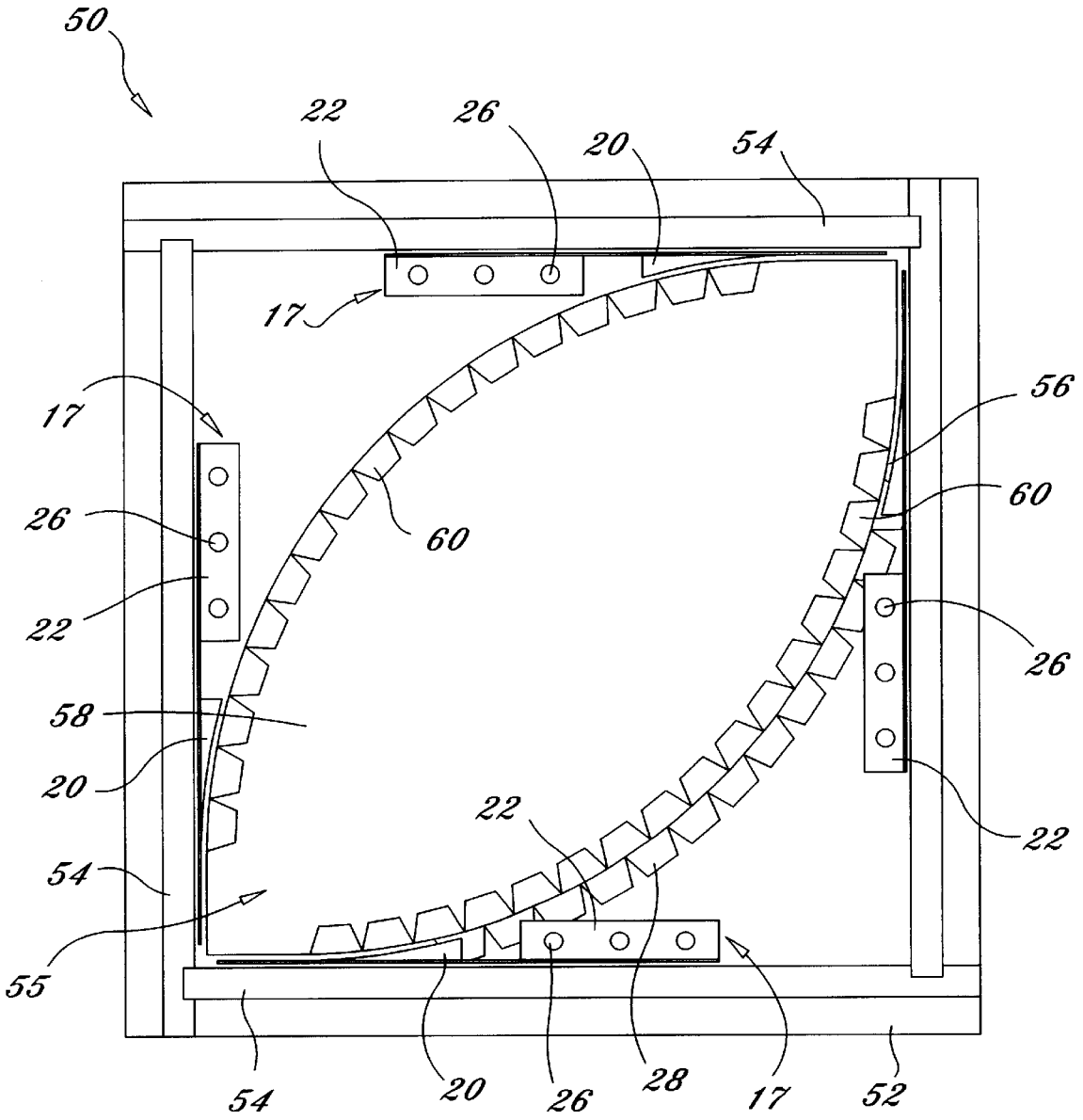
FIG. 8 is a plan view of the preferred embodiment of the mold and kit of the instant invention used in simultaneously making two prefabricated plaster arches in accordance with the instant invention.
Figure 9:
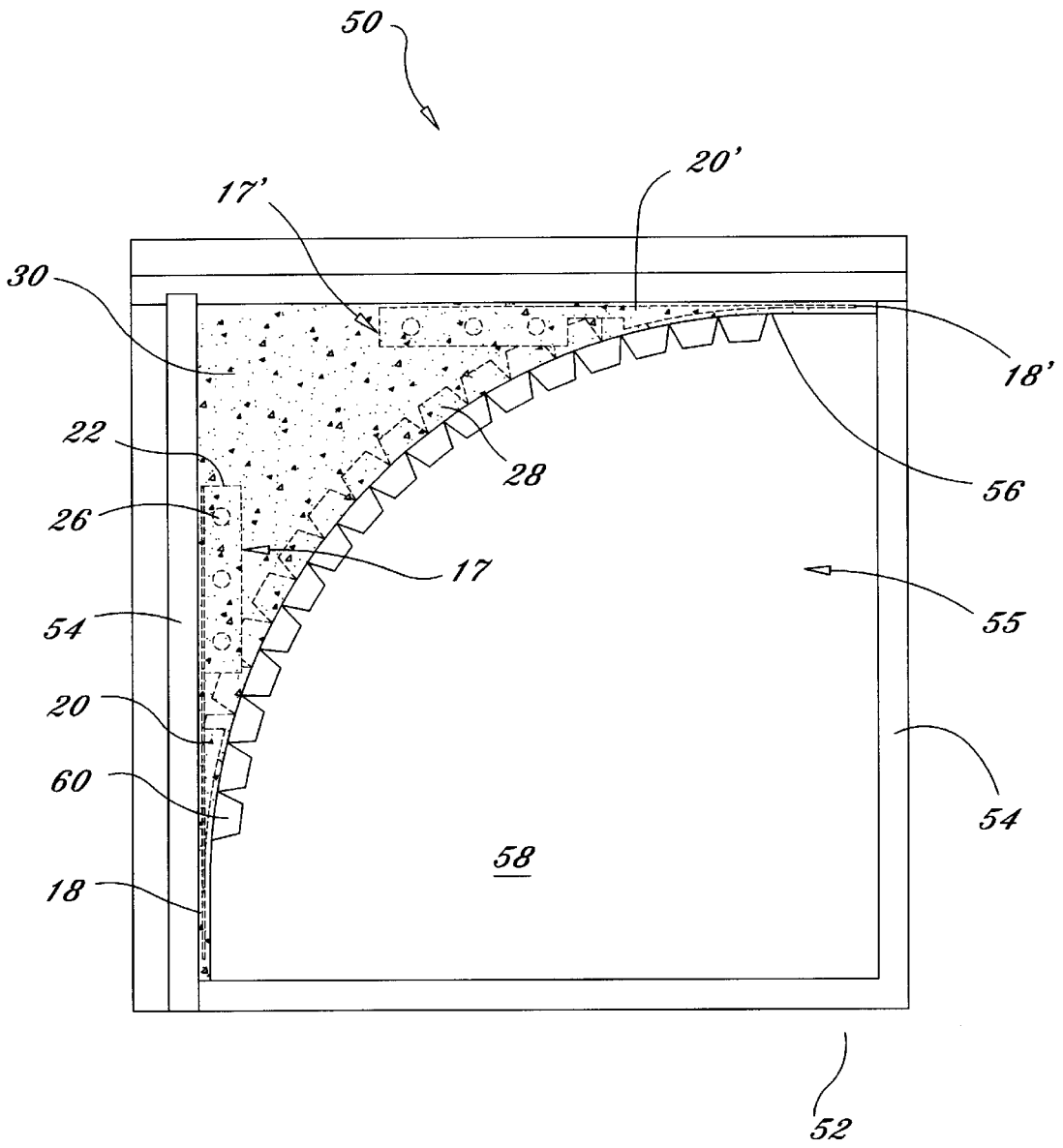
FIG. 9 is a plan view of the preferred embodiment of the mold and kit of the instant invention used in making one prefabricated plaster arch in accordance with the instant invention.
Figure 10:
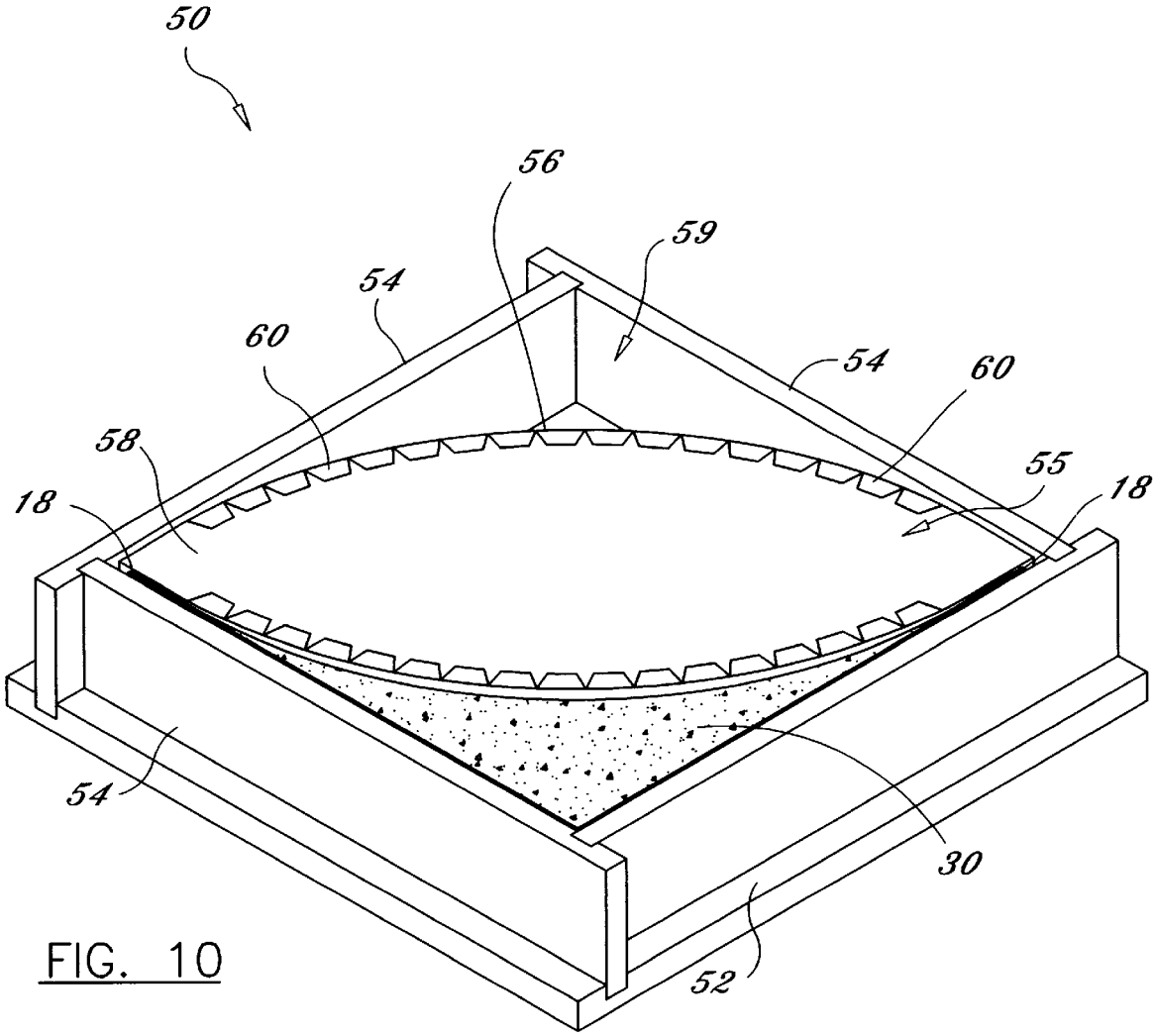
FIG. 10 is a perspective view of the preferred embodiment of the mold and kit of the instant invention showing one chamber filled and another chamber empty.
Figure 11:
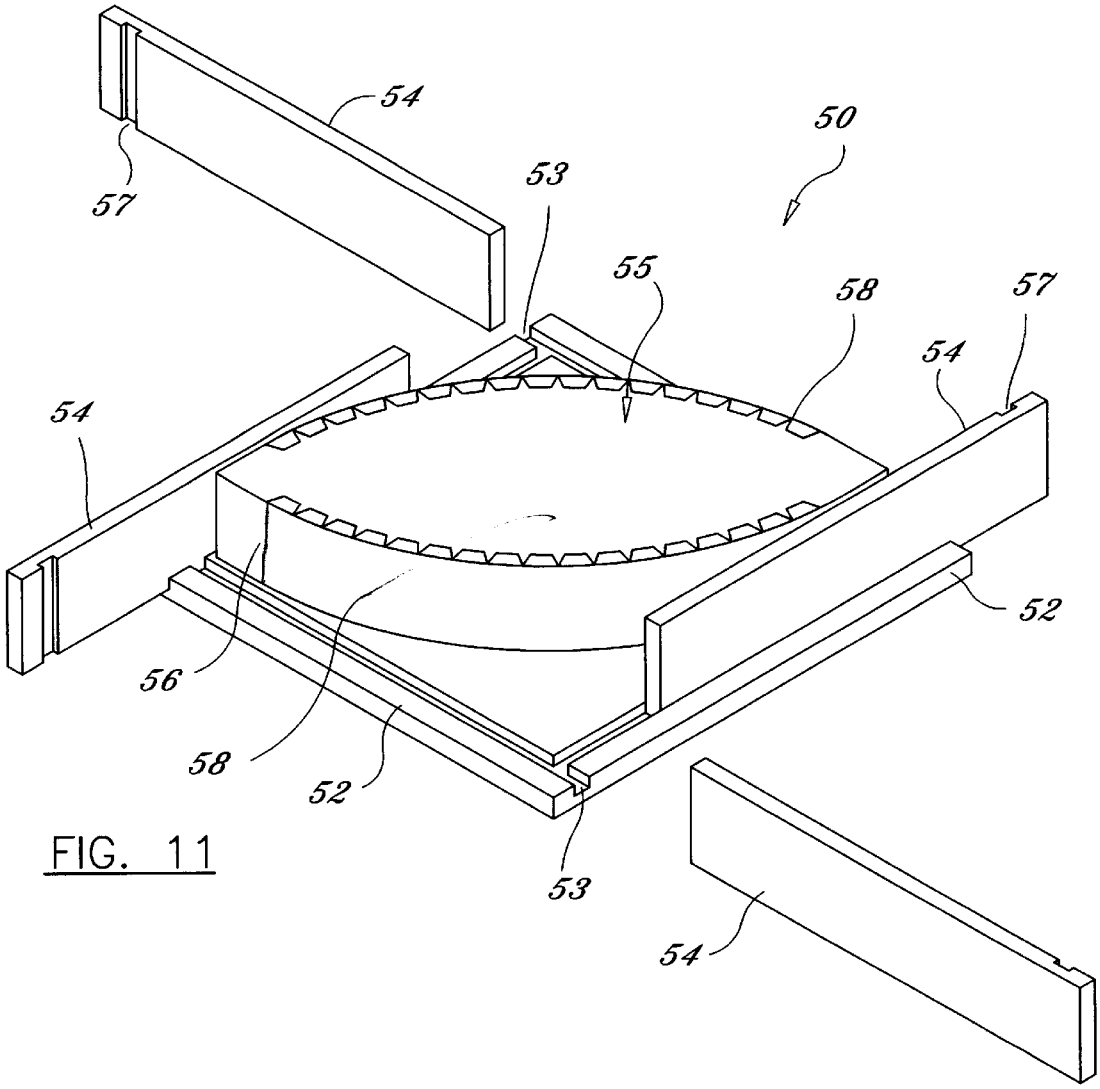
FIG. 11 is a perspective view of the preferred embodiment of the mold and kit of the instant invention, with the side panels shown removed, illustrating two prefabricated plaster arches before removal from the mold as made in accordance with the instant invention.

With reference to FIGS. 8 and 9, the invention also comprises a mold 50, kit and method for making prefabricated doorway arches. Referring to FIG. 9, the mold 50 generally comprises a main mold body formed by a box-like structure having a bottom panel 52, at least two substantially perpendicular and removable side panels 54 and at least one concave and arcuate panel 56 bridging the side panels 54. The side panels 54, bottom panel 52 and arcuate panel 56 define a chamber 59 therebetween and therein for filling with plaster 30 or plaster-like material for making at least one arch 10. The base 52 defines at least one track or channel 53 for slidably receiving each side panel 54. The mold 50 may also provide at least one securing clamp 17 or securing tab 18. The arcuate molding surface may be defined by an arch forming boss 55 projecting upward from the bottom panel 52. The arch forming boss 55 comprises one arcuate molding surface 56 for making one arch 10 and two arcuate molding surfaces 56 for making two arches 10. The arcuate molding surface 56 may include a molding stile or plate 60 for separating and providing for convenient separation of the molded arch 10 from the mold 50. A comer bead 28 may be placed in the bottom of the chamber 59 along the arcuate molding surface 56 before pouring in the fill. Thereafter, a corner bead 28 may be placed at the top of the chamber 59 along the arcuate molding. The corner beads 28 provide structural integrity along the edges of the arches 10. Prior to filling the chamber with the required fill, as disclosed herein, the securing clamp(s) 17 or 17' should be positioned in the chamber 59 adjacent the side panels 54.

With reference to FIG. 8, the mold 50 may comprise structure for forming and making at least two arches 10 in another embodiment. In this embodiment, the mold generally includes two sets of substantially perpendicular and removable side panels 54 and two arcuate molding panels or surfaces 56. Two sets of comer beads 28 and securing clamps 17 and/or tabs 18 may also be provided with the mold and/or kit. The bottom panel 52 defines and/or provides a track or channel 53 for each side panel 54. The two sets of side panels 54 comprise four slidably removable panels, wherein the first and second sets are in opposing positions. The two concave and arcuate panels/surfaces 56 are preferably defined along opposite surfaces of the boss 55 and engage the first and second sets of side panels 54. The two sets of side panels 54, arcuate panels 56 and bottom panel 52 define two independent chambers 59 therebetween and therein for filling with plaster 30 or a plaster-like material to make at least two arches 10. A cover or top may be provided to conceal the fill while it sets and cures. The side panels 54 may each include a notch 17 for slidably receiving the end of a side panel 54 to effectuate a substantially modular fit that stabilizes the side panels 54 during the filling, setting and curing steps. The side panels 54 may be further stabilized with a removable and adjustable strap that may be tightened and loosened.

The process of making arches 10 in accordance with the invention generally comprises securely setting the side panels 54 on the bottom panel 52, installing or inserting a securing clamp 17 or securing panel 18 in each chamber 59, filling each chamber with a predetermined filler, such as plaster, concrete or other filler provided for herein, leveling and floating the poured fill, allowing the fill to set, removing the side panels after the fill has fully cured, and/or removing the arch or arches 10. The method of the invention may also include placing a comer bead 28 in each chamber adjacent the arcuate molding surface 56, tightly securing a strap around the outer peripheral surfaces of the mold 50 and/or leveling the fill with a trowel or other instrument to remove excess fill spilling over or rising above the side panels' 54 top edges and the top surface of the arch forming boss 55. The side panels 54 are slidable set or placed within the tracks 53 defined by the bottom panel 52. A securing clamp 17 or tab 18 is placed in each chamber 59 so that the plaster retaining projection(s) 20 and locking tab(s) 22 are substantially parallel with the bottom panel and the securing tabs 18 project outward from the chamber(s) 59. The chambers 59 are preferably filled with a plaster 30, but may also be filled with a paste, concrete, stucco, liquid plastic, joint compound or other suitable filler. Once the fill 30 is completely set and cured, the strap is removed (if one was used), the side panels 54 are removed from the main body and the arches 10 removed. The side panels may slide within tracks formed in the bottom panel. The mold body also makes it convenient to uniformly and evenly remove excess filler from the chamber(s) with a trowel blade and to set an arcuate corner bead 28 in the fill. The kit of the invention includes the mold 50 with at least one chamber 59, at least one securing clamp 17, 17' and/or tab 18, 18' and a filler mix 30 for filling the chamber(s). The kit may further include at least one pair of corner beads 28 having slits cut therein for facilitating easy shaping and a retaining strap.

The method of the invention may further include installation of at least one arch 10 or two arches 10, which comprises the steps of aligning the plaster arch 10 in the desired comer of the desired opening, passing or forcing at least one fastener through each securing tab 18, 18' into the corresponding wall surface behind the securing tab 18, 18', filling or concealing the seams between the arch and wall/ceiling surface with a joint compound, sanding or texturing the surface smooth and painting the arch.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. An arch segment molding kit for making quarter arch segments that are mountable in the upper corners of passageways, which have predetermined wall widths, to facilitate the formation of archways, said arch segment molding kit comprising:

a substantially rectangular base;

at least two side boards being removably mountable to said base along adjacent edges;

an arcuate wall projecting upward from said base and extending substantially between said adjacent walls, said arcuate wall and said side boards defining a plaster receiving chamber;

at least one securing flange being at least partially disposable inside said chamber along each of said boards; and means for receiving a fill that hardens over time inside said chamber.

2. An arch segment molding kit as recited in claim 1, wherein said base further comprises:

at least one channel defined in said base along and proximal to said adjacent sides for slidably receiving said side boards.

3. An arch segment molding kit as recited in claim 1, further comprising:

a fill that hardens over time for placement in said chamber.

4. An arch segment molding kit as recited in claim 1, wherein said means for receiving fill comprises:

an open top end defined by said side boards and said arcuate wall.

5. An arch segment molding kit as recited in claim 1, further comprising:

a substantially stickless panel affixed to said arcuate wall for preventing said fill from sticking to said arcuate wall when hardening.

6. An arch segment molding kit as recited in claim 1, wherein said arcuate wall is defined by an arch forming boss projecting upward from said base.

7. An arch segment molding kit as recited in claim 6, further comprising:

an adjustable strap for wrapping around said side boards and said arch forming boss for retaining said side boards to prevent bulging.

8. An arch segment molding kit as recited in claim 1, further comprising fasteners for securing an arch segment in the upper corner of a passageway.

9. An arch segment molding kit as recited in claim 1, wherein said securing flanges each comprise:

a flat base having a first end and mid-section that are disposed in said plaster filled volume and a second extending outward from said mid-section and said plaster filled volume; and at least one arcuate flange projecting upward from said flat base and having a top surface geometry that corresponds to said arcuate side.

10. An arch segment molding kit as recited in claim 9, wherein said first and second securing flanges each comprise:

at least one flange projecting upward from said flat base proximal to said first end and said mid-section.

11. An arch segment molding kit as recited in claim 10, wherein said securing flanges are rigid and bendable.

12. An arch segment molding kit as recited in claim 1, wherein said side boards define a width corresponding to the wall widths such that said arch segment formed in said chamber, substantially aligns with the passageway walls.

13. An arch segment molding kit as recited in claim 12, wherein said molding kit forms an arch segment device having a width that is less than the wall widths to facilitate floating said arch segment device with the passageway walls.

* * * * *